US006411718B1

(12) United States Patent
Danley et al.

(10) Patent No.: US 6,411,718 B1
(45) Date of Patent: Jun. 25, 2002

(54) SOUND REPRODUCTION EMPLOYING UNITY SUMMATION APERTURE LOUDSPEAKERS

(75) Inventors: Thomas J. Danley, Highland Park; Bradford J. Skuran, Glenview, both of IL (US)

(73) Assignee: Sound Physics Labs, Inc., Glenview, IL (US)

( * ) Notice: Subject to any disclaimer, the term of this patent is extended or adjusted under 35 U.S.C. 154(b) by 0 days.

(21) Appl. No.: 09/301,668

(22) Filed: Apr. 28, 1999

(51) Int. Cl.[7] ..... H04R 25/00

(52) U.S. Cl. ..... 381/342; 381/182; 381/340; 181/144; 181/152

(58) Field of Search ..... 381/342, 182, 381/186, 334, 338, 339, 340, 345; 181/144, 147, 152, 159

(56) References Cited

U.S. PATENT DOCUMENTS

| | | | | |
|---|---|---|---|---|
| 1,674,683 A | | 6/1928 | Hahnemann | |
| 1,767,358 A | | 6/1930 | Gottshall | |
| 1,907,723 A | | 5/1933 | Bostwick | |
| 1,992,300 A | | 2/1935 | Fanger | |
| 2,107,757 A | | 2/1938 | Kinsley | |
| 2,269,284 A | | 1/1942 | Olson | |
| 2,638,510 A | | 5/1953 | Brami | |
| 3,065,816 A | | 11/1962 | Ranger | |
| 3,898,384 A | | 8/1975 | Goeckel | |
| 4,174,019 A | | 11/1979 | Kramer | |
| 4,256,930 A | | 3/1981 | Garner et al. | |
| 4,437,540 A | * | 3/1984 | Murakami et al. | 181/147 |
| 4,469,921 A | | 9/1984 | Kinoshita | |
| 4,619,342 A | | 10/1986 | Buck | |
| 4,836,327 A | | 6/1989 | Andrews et al. | |
| 4,845,759 A | | 7/1989 | Danley | |
| 4,885,782 A | | 12/1989 | Eberbach | |
| 4,969,196 A | | 11/1990 | Nakamura | |
| 5,004,067 A | | 4/1991 | Patronis | |
| 5,046,581 A | | 9/1991 | Mitchell | |
| 5,109,423 A | | 4/1992 | Jacobson et al. | |
| 5,526,456 A | | 6/1996 | Heinz | |
| 5,857,027 A | | 1/1999 | Gaidarov et al. | |
| 5,872,338 A | | 2/1999 | Hanson | |
| 6,038,326 A | * | 3/2000 | Czerwinski | 381/340 |
| 6,118,883 A | * | 9/2000 | Rocha | 381/340 |

FOREIGN PATENT DOCUMENTS

| | | |
|---|---|---|
| GB | 303837 | 3/1930 |
| GB | 723604 | 2/1955 |
| JP | 9-33517 | 2/1997 |

* cited by examiner

*Primary Examiner*—Duc Nguyen
*Assistant Examiner*—Suhan Ni
(74) *Attorney, Agent, or Firm*—Fitch, Even, Tabin & Flannery

(57) ABSTRACT

The present invention relates to systems and methods for sound reproduction employing a unity summation aperture loudspeaker horn taking advantage of the frequency response of horn flare characteristics for positioning of audio drivers along the outer wall of the loudspeaker horn. The loudspeaker horn may be embodied as any of a variety of pyramid shapes which allows for sections for driver positioning in correlation with the frequency response of the horn. Positioning the driver sources along the sides of the horn and out of the way of the audio field facilitates at least two modes of operation including a transformation operation for acoustical impedance matching and a waveguide operation for directing the reproduced audio signals. The single horn, multi-driver approach provides highly coupled audio drivers to generate sound reproduction employing unity summation aperture loudspeakers.

19 Claims, 6 Drawing Sheets

FIG. 2B
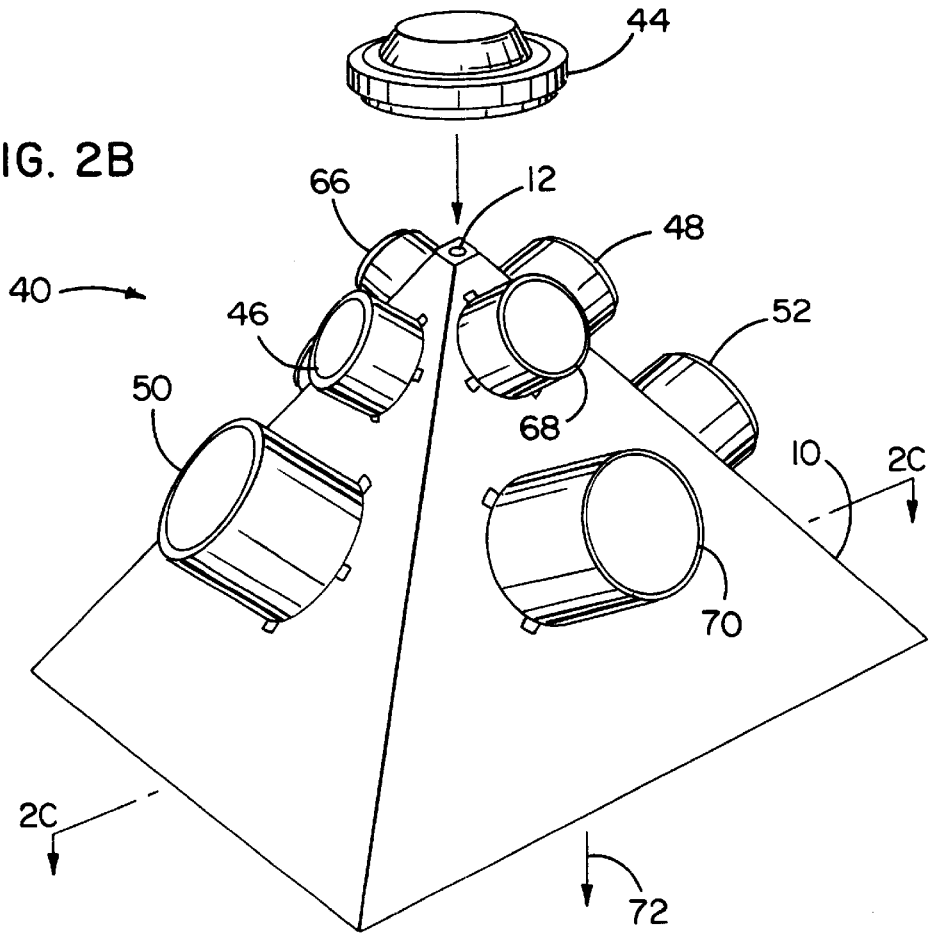
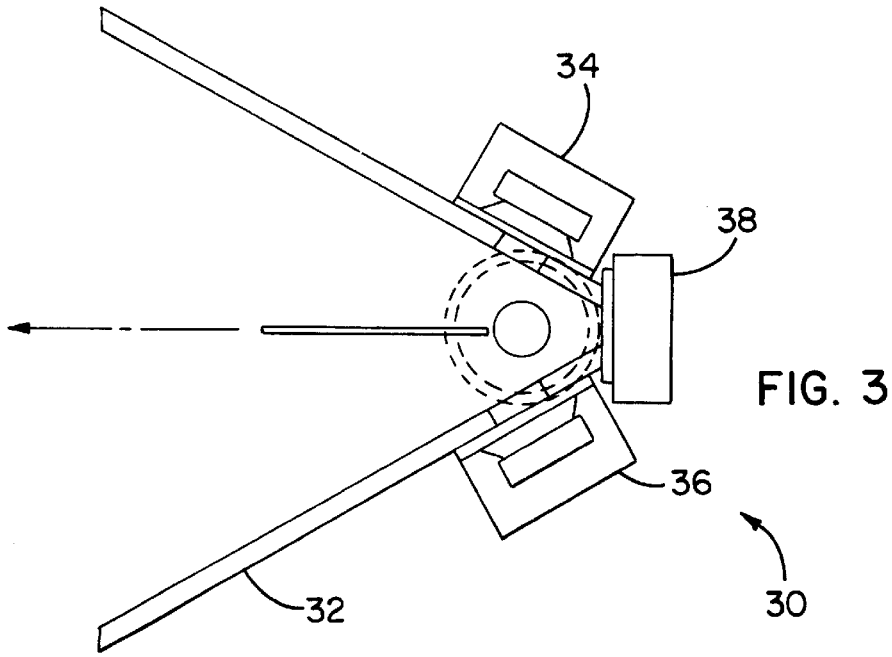
FIG. 3

SOUND REPRODUCTION EMPLOYING UNITY SUMMATION APERTURE LOUDSPEAKERS

BACKGROUND OF THE INVENTION

1. Field of the Invention

The present invention relates to sound reproduction and more particularly to systems and methods to provide a more powerful, broader bandwidth loudspeaker horn.

2. Description of the Related Art

When large acoustic powers are required for music or voice sound reinforcement, large arrays of loudspeakers are typically used. However, it has been observed that there are certain self destructive relationships generating audible interference in such systems and that the audience may be better served by a more powerful single (or two for stereo, etc.) source(s) of sound. Unfortunately there are audio output limitations on a practical single source loudspeaker. The back bone of all sound systems are horn loudspeakers which typically handle all the frequencies above the Bass or mid-range of the sound. Horns of current art have a number of problems, which cause them to be largely ignored in the high fidelity area.

In professional sound systems, one finds that there are also limits due to the physics involved and materials available to construct the loudspeaker drivers as to how powerful a single horn can be made. Additionally, audio distortions peculiar to horn drivers are related to the loudness and bandwidth of sound being produced. This problem is called "throat distortion" and is more or less a product of the intensity of the sound times the distance it travels in the horn.

Classical horn theory says that a horn is an impedance transformer with the driver at one end and the acoustic load at the other. The advantage of the horn is that it can greatly increase the efficiency and acoustic power over the driver alone. Looking further, one finds that a horn has a low frequency cutoff defined by the flare rate of the horn, for example the classic exponential horn may double its area, e.g., every 24 inches for a 30 Hz flare and every 2.4 inches for a 300 Hz flare and so on. The louder the audio output, and the wider the response (longer horn due to accommodate operation at lower frequencies), the worse the distortion. Starting at the driver diaphragm of a conventional loudspeaker, the sound pressure is highest at the throat of the horn and as the flare of the horn increases in area, the sound pressure falls roughly inversely proportional to the area increase. In this case one finds a horn with a higher low cutoff (faster flare) has less distortion for the same intensity. This throat distortion problem is not dependant on the materials the driver is constructed from and is probably the primary limiting factor in the loudness/bandwidth.

Accordingly, it would be desirable to provide a sound reproduction system employing single source loudspeakers taking advantage of the frequency response of the loudspeaker horn itself, while avoiding signal distortions to present an unified audio signal with a sum of the operating frequency ranges from the sound reproduction system.

SUMMARY OF THE INVENTION

The present invention provides at least a single horn which has multiple drivers arranged to utilize the sections of the horn positioned for desired frequency characteristics of the horn, rather than using several nested horns. Whereas in this approach, there is only one horn and all of the drivers are highly coupled to it. In a described embodiment, the angle of the wall is the same for each case to provide several loudspeaker sources along the horn with the drivers being positioned out of the way of the audio path.

Whereas, normally horns may be provided, one each for each audio range, with woofer cones on the face of the final flare as a convenient placement out of the way, such systems are not actually horn loaded with a series of drivers combined to provide a three-way horn. A multi-way speaker system is provided herein to include a three-way system with a mid-range, a tweeter, and a base speaker for a transformation over the entire range where all of the drivers are acoustically highly coupled to each other. Thus the horn is designed to do more than one job, partitioning the conical flare to put the full frequency range through the single loudspeaker system.

Briefly summarized, the present invention relates to systems and methods for sound reproduction employing a unity summation aperture loudspeaker horn taking advantage of the frequency response of horn flare characteristics for positioning of audio drivers along the outer wall of the loudspeaker horn. The loudspeaker horn may be embodied as any of a variety of pyramid shapes which allows for sections for driver positioning in correlation with the frequency response of the horn. Positioning the driver sources along the sides of the horn and out of the way of the audio field facilitates at least two modes of operation including a transformation operation for acoustical impedance matching and a waveguide operation for directing the reproduced audio signals. The single horn, multi-driver approach provides highly coupled audio drivers to generate sound reproduction employing unity summation aperture loudspeakers.

The appended claims set forth the features of the present invention with particularity. The invention, together with the advantages described herein may be best understood by the following detailed description taken in conjunction with the accompanying drawings.

DESCRIPTION OF THE DRAWINGS

FIG. 2B shows an exploded perspective view in accordance with the invention;

FIG. 3 shows an embodiment as a two-way system on four-sided pyramid;

DETAILED DESCRIPTION OF THE PREFERRED EMBODIMENTS

Figure 1:
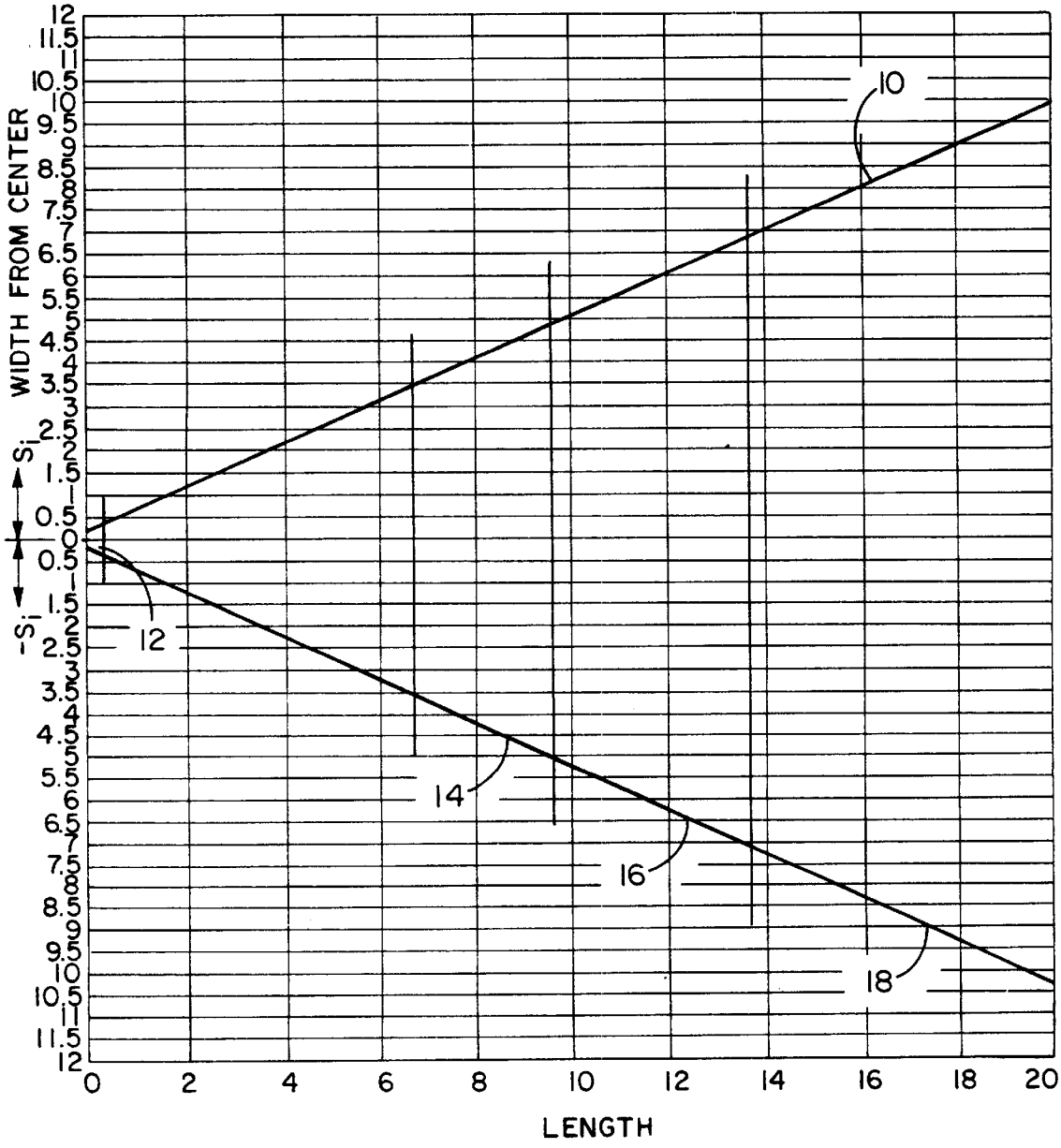
FIG. 1 shows a typical straight sided flare with the effective flare rate shown in several locations.

Reference will now be made in detail to the present preferred embodiments of the invention, examples of which are illustrated in the accompanying drawings. As depicted in FIG. 1 and particularly FIGS. 2A and 2B, a loudspeaker enclosure 10 embodying the sound reproduction system employing unity summation aperture loudspeakers is shown having a unitary construction advantageously allowing easy placement along the sides of a pyramid-shaped loudspeaker horn. As illustrated, the loudspeaker horn may be sectioned into regions along the outer wall of the horn according to the audio frequency characteristics and response to the generated audio signal, facilitating the positioning of loudspeaker driver sources along the loudspeaker horn 10 for audio signal summation as discussed below.

While there are many types of expansion rates such as hyperbolic tractrix, exponential and parabolic, there is only one general type that will function in an embodiment, that is the conic or quadratic flare generally provided with horns having more or less straight walls. This type of flare is sometimes used to make horns or "waveguides" which sacrifice low frequency loading for a controlled directivity pattern, some of the horns called "constant directivity" also employ horns with roughly straight walls.

The horn may be provided to perform either of two general types or regions of operation, the first, starting at the throat, the pressure is high and the horn is doing its job as a transformer. When the diameter of the horn (when round) reaches approximately one wavelength in circumference, it has reached it's final loading impedance and acoustical transformation beyond here is minimal so between this point and the throat is where the "work" gets done. Continuing towards the mouth, one reaches a point where the wall angle confines the radiated sound until the wall angle of the sound radiation are roughly equal. While this relationship is in play, the radiated angle of the sound will be essentially constant with frequency hence the name "constant directivity". To separate the two acoustic functions, the operation from the driver to 1λ circumference point may be referred to as the "transformation" operation (acoustical impedance matching), and operation from that point forward may be referred to as "waveguide operation". When a regular "curved wall" horn is used, the dispersion angle narrows as the frequency is increased.

When one compares a conical/quadratic flare to an exponential or other more common type, one sees that with the conic horn (like a hollow pyramid with the driver at the apex) that the expansion rate is initially very rapid (the reason for poor low frequency loading). With this type of horn, in effect, the flare rate gradually slows or becomes suitable for a lower frequency the further you put the throat towards the mouth. FIG. 1 shows a typical straight sided flare of the loudspeaker horn 10 with the effective flare rate shown in several locations. When this horn is driven in the conventional manner, one sees is that at the tip 12, where the driver is, the flare rate is that of a high frequency horn and as one moves away from the driver, the expansion rate slows and becomes that of a horn for a lower frequency. Expansion of the flare of the horn 10 as indicated in regions 12, 14, 16, and 18 may be segmented into various frequency response ranges for driver positioning. Normally, the driver is connected to the high frequency part 12 of the horn and the loading from the low frequency parts 14, 16, 18 are not transferred through the high frequency section 12. The effect is as if there were several "high pass" filters (each segment) that had a progressively lower cut off as the size increased. Unfortunately it is the smallest, highest frequency section that is coupled to the driver at the tip. The inferior low frequency loading of this arrangement is why this type of flare is normally only used at high frequencies where its directivity is a primary concern. As sectioned, the horn 10 flare as shown extends 20 inches to a 20"×20" mouth. The 1 inch throat (region 12) doubles the throat area in less than 1 inch, whereas region 14 takes 2 ½ inches to double for a lower frequency range. Region 16 takes 4 inches to double its areas, and region 18 takes 7 inches to double for mid-range and low frequency responses.

The device in question uses the horn 10 to provide acoustic loading over a wide range of frequencies. While other designs have successfully combined the output of several drivers into a horn intended to act as a waveguide (providing directionality but not significant acoustic gain as in "normal" horn loading), none have addressed the requirements needed to have the outputs from all the drivers add together uniformly into one common horn working without transitions over the entire frequency range. The closest is several "nested" horns using electronic delay to offset a non-ideal driver location, as described in U.S. Pat. No. 5,526,456 to Heinz for "Multiple-Driver single Horn Loud Speaker. Nonetheless, Heinz still only provides the acoustic operation of several different horns independently. In the described embodiment of the present invention, the high range source is provided as being large enough by itself to load the driver so as not to be shadowed by the horn which it is mounted in, providing a conical flare which has in effect different flare rates depending where you cut into it, Doubling the area every so many inches corresponds to a flare rate appropriate for the frequencies that are being produced rather than trying to nest several horns one within the other.

Figure 2A:
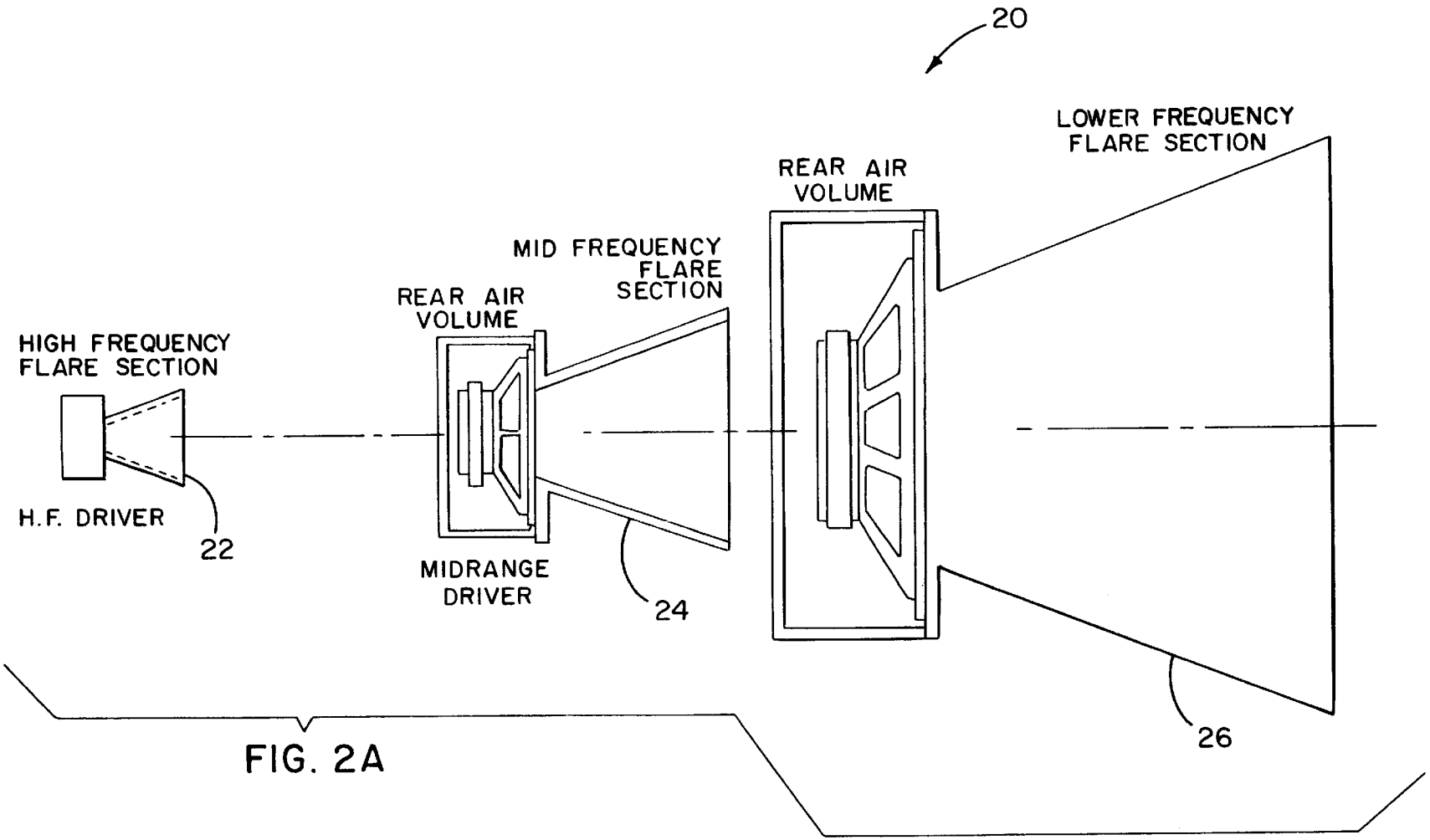
FIGS. 2A and 2C are sectional views of unity summation aperture loudspeakers.

The described embodiment divides the horn into ranges of operation corresponding to available drivers. FIG. 2A illustrates a system 20 employing three separate horn systems 22, 24, and 26 each designed for a specific range. As discussed, the loudspeaker horn is sectioned in accordance with the frequency response as indicated in FIG. 1. The introduction of the loudspeaker drivers at the respective sections of the loudspeaker horn facilitates the unity summation aperture for sound reproduction to provide optimal coupling of the audio signal without interference between the audio signals of the various frequency ranges.

Figure 2C:
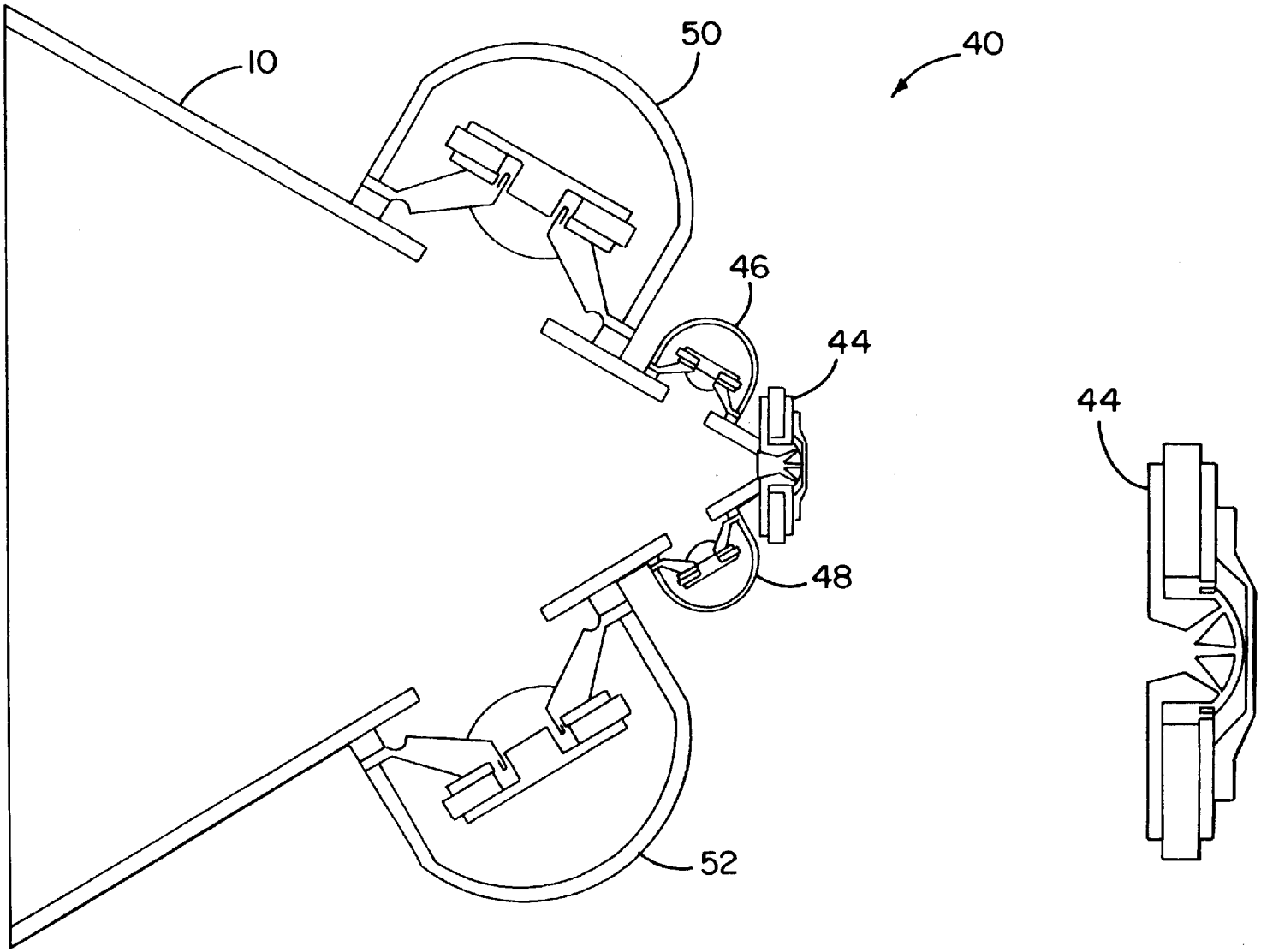

FIGS. 2A and 2C are sectional views of unity summation aperture loudspeakers, and FIG, 2B shows an exploded perspective view of the described pyramid embodiment of horn 10. FIG. 2C shows a preferred embodiment in cross section facilitating the unity summation by positioning loudspeakers along the pyramid sides of the horn 10, and away from the interior of the horn to facilitate the use of the horn 10 in common with the multiple loudspeakers. As shown in FIG. 2B, the high frequency driver 44 is positioned over throat 12, with the other loudspeaker drivers being similarly fashioned to be received at throats or openings alongside the horn 10. To this end, mid-range drivers 46, 48, 66, and 68 are used to generate the mid-range frequencies inside the horn 10, as described further below. Low frequency drivers 50, 52, 70, and an opposing driver to driver source 70 generate the low frequency signals which emanate as indicated by the arrow 72 in summation with the audio signals generated by the other drivers positioned along the surface of the horn 10.

The cross-sectional view of FIG. 2C illustrates the wide bandwidth, high power horn driver with controlled signal dispersion. When designing the horn and driver system 40, the requirements for bandwidth, constant dispersion angle, and low distortion may be somewhat contradictory in relation to one another. The described embodiment is designed according to loudspeaker design specifications to facilitate the equivalent of the sources shown in FIG. 2A, but FIG. 2C providing the sources so as not to interfere with one another. Herein, the three way system shown in FIG. 2C employs the basic design segments of a conical horn according to the equivalent flare rate. The drivers 44, 46, 48, 50, 52 shown in cross section are selected for various frequencies and coupled to the horn 10 in a way which matches the acoustic impedances of the various sections of the horn 10 and the respective drivers.

The constant directivity requirement in a point source or a line source application is satisfied using a conical, e.g., the straight-sided flare horn 10. Although a conical horn may provide for low frequency loading, somewhat reducing the bandwidth, it may be appreciated from the chart of FIG. 1 showing the relationship between expansion rate and the low frequency corner, which may be compensated as described below. The described conical system 40 starts out with a very rapid flare rate and, since the horn 10 is in effect a high pass filter, a high frequency corner frequency is provided. A horn with a curved wall, e.g., an exponential flare, may also be employed, which provides better low frequency loading, except as the frequency produced increases, the angle of coverage may decrease. Also, loudspeaker horns are known to produce throat distortion, which is caused by nonlinearity of the air under high sound pressure such as the high pressures found at the throat of the driver. Even where an acceptable compromise is achieved between bandwidth and directivity, a maximum level is limited by the distortion, which is aggravated with wide bandwidth and high power signals as described above.

Accordingly, the embodiment 40 described herein takes advantage of the conical horn characteristic of having a flare rate which effectively changes depending upon where the driver signal is introduced between the throat and mouth of the horn 10. It is observed that a given conical horn 10 can be driven satisfactorily at a lower than conventional frequency provided that a suitable driver is coupled at the point where the flare rate is appropriate for the desired low frequency response. In other words, one could cut the flare of the horn 10 as discussed herein, into, e.g., three or more parts, at the apex 12 having the most rapid flare rate; at the middle section 14 which provides a medium flare rate; and at the end nearest the mouth, sections 16 and 18 of FIG. 1, where the flare rate is relatively slow for lower frequency operation. Accordingly, with the provision of suitable drivers, the horn loading at the respective frequencies is acceptable. It is realized therefore that by moving the drivers out of and away from the acoustic path, the horn 10 sections may be cascaded to form one large horn, with drivers still being coupled at their proper impedances respectively.

The horn 10 of the system 40 described herein was designed as having a mouth area of sufficient area for the lowest frequency of interest, while defining a suitable coverage angle. The horn 10 is thus cut into equivalent or imaginary sections according to the respective flare rates at points where suitable drivers for the desired frequencies are attached as shown in FIG. 2B. Thus, the loudspeaker drivers communicate to the horn through holes or passages, the sum of which are equal to the horn area so as to match the horn's impedance at the introduction point. The drivers are mounted outside the acoustic path so as not to lock or reflect high frequency radiation from the apex 12 where the high driver 44 resides, which leaves an unobstructed acoustic path 72 for the highest frequencies most prone to reflect inside the horn 10.

The described embodiment also complements the phase shift, and in effect the time delay, caused by typical crossover filters. By placing the crossover frequencies such that the acoustic phase shift between the higher and lower drivers and the electrical phase shift in the crossover is approximately equal to the phase shift (delay) in the air path, the outputs from the higher and lower drivers combined in phase. The crossover filters utilized are typically either passive or active so as to produce a 90 degrees phase shift between the high and low frequency outputs, at the crossover frequencies. Thus, the sequence of operation may provide a wide band signal having equal energy in each octave. As the signal is applied to the crossover network, the first part provided is the high frequency portion, which propagates down the horn 10. Next, the mid-frequency portion is produced synchronously with the high frequency portion, and the low frequency portions are similarly provided by the crossover network to the respective drivers in proper time. The approach may be extended to multiple sections beyond three-way operation. The effective result is a horn 10 which provides a very wide band width, controlled directivity, and very high acoustic power in a single horn which may not be achieved in a single conventional driver. Because the mid and lower frequencies are produced by drivers, and because the larger area provided at the introduction of the signals, a lower throat pressure results in much lower than typically observed distortions due to the air nonlinearity effects discussed above.

The design or selection of an appropriate driver for each range is an important process determining the correct acoustic impedance and hence the dimensions to couple the driver to the horn related to the throat area. The entry area into the horn is thus smaller than the actual cone to match the driver's impedance to the horn's impedance.

Rather than have three separate horns as is commonly done, it was realized that the three sections (all having the same wall angle) could be cascaded. Possible, provided the drivers and any other obstructions be moved out of the new acoustic path but still connected with the proper acoustic impedance for each range of operation. Due to the new location of the drivers, typically multiple smaller drivers are used but still with the same or similar total driver parameters, as in FIG. 3 (shown as a two-way system 30 on a four-sided pyramid 32).

When the sound from several sources combine, the result depends on both the amplitude and phase of the signals. Proper addition only happens when the drivers are "in phase". This makes it necessary to account for not only the driver system's acoustic amplitude and phase shift but also the crossover network.

With the system shown in FIG. 3, all of the driver 34, 36, 38 generate their audio signals at once, and thus the sound would arrive in several "lumps" roughly corresponding to the distance away they were. Other art attempts to account for these time differences with electronic delays and compensation, which may be used but are not needed in this embodiment. The needed time/phase correction is done by considering the physical position of each set of drivers and total phase shift in both the drivers and crossover. Due to the complexity of the individual horn element's equivalent circuit, this process involves approximation and measurement.

Because of the complexity of the factors involved, one must first decide a "beginning" crossover frequency for the highest driver, let's say it is 1 kHz. One calculates ¼ wavelength ($\lambda$) in air at 1000 Hz to account for the electrical 90 degree phase difference between the upper and lower drivers coming out of the crossover. One then estimates (or measures) the distance from the radiator to the ¼$\lambda$ point in the horn and measures the horn area at that point. Using the horn/driver design criteria, suitable horn loading is provided with an upper cutoff at or above 1000 Hz and has a required throat area equal to the horn area at the ¼$\lambda$ point. The acoustic output from the driver is directed through holes or passages into the sides or corners of the horn at the ¼ wavelength from the higher range driver. In other words halfway between right at the crossover, there is a time delay or phase difference between the high path's and the low path's part of it, i.e., a quarter of a wavelength equivalent and in order to compensate for that what you end up doing is moving the higher frequency driver back a quarter wavelength and then when the sound from the high frequency driver reaches the low frequency one, it will be producing the right things, in other words the time orientation is correct.

As the air in the passage has acoustic reactance, it is desirable to keep the path length short, corner placement of the passageway if not a round horn is typical. Since the driver's output combines in a space of a small fraction of a wavelength, there is nearly ideal coupling of the drivers into the horn (forming one larger driver). Now, since there are some "unknown" values in the equivalent circuit, the real correct crossover frequency may be found. The drivers are temporarily wired out of phase and a frequency sweep done. At approximately twice the crossover frequency one will see a deep notch (deep because the drivers are very well coupled and out of phase 180 degrees). At the notch frequency, the drivers are acoustically 180 degrees out of phase so at half that frequency, they will be 90 degrees out of phase and that is the "correct" crossover frequency based on the actual acoustic properties. If the drivers have excess reactance or changing response in this area, the actual values for the crossover components often require some "tweaking". To get the best results, a more comprehensive computer model is in progress.

In the system outlined above, the high frequencies (in this case above about 1 kHz) enter the apex of the flare and at about ¼ wavelength (at 1 kHz) down the horn passages the output from each of four mid-drivers connect to the horn. In this case, the throat area for the high frequency section is 0.78 square inches while the lower portion drivers have a throat area of 10 square inches and enter the horn where the horn area is 10 square inches. As mentioned earlier, throat distortion is related to bandwidth and intensity. Acoustic power is related to pressure times area. In this design, one can see that the energy above 1 kHz enters a horn with a rapid flare rate, ideal for minimizing distortion. Energy below 1 kHz enters the horn with an area of 10 square inches, more than ten times the area of the high frequency (hf) section. As a result, for a given acoustic power, the horn pressure below 1 kHz is much less than above 1 kHz. Thus, the one horn can radiate vastly more acoustic power for a fixed level of distortion by in effect tapering off the pressure as frequency declines but maintaining the acoustic power by having appropriately larger drivers.

Figure 4:
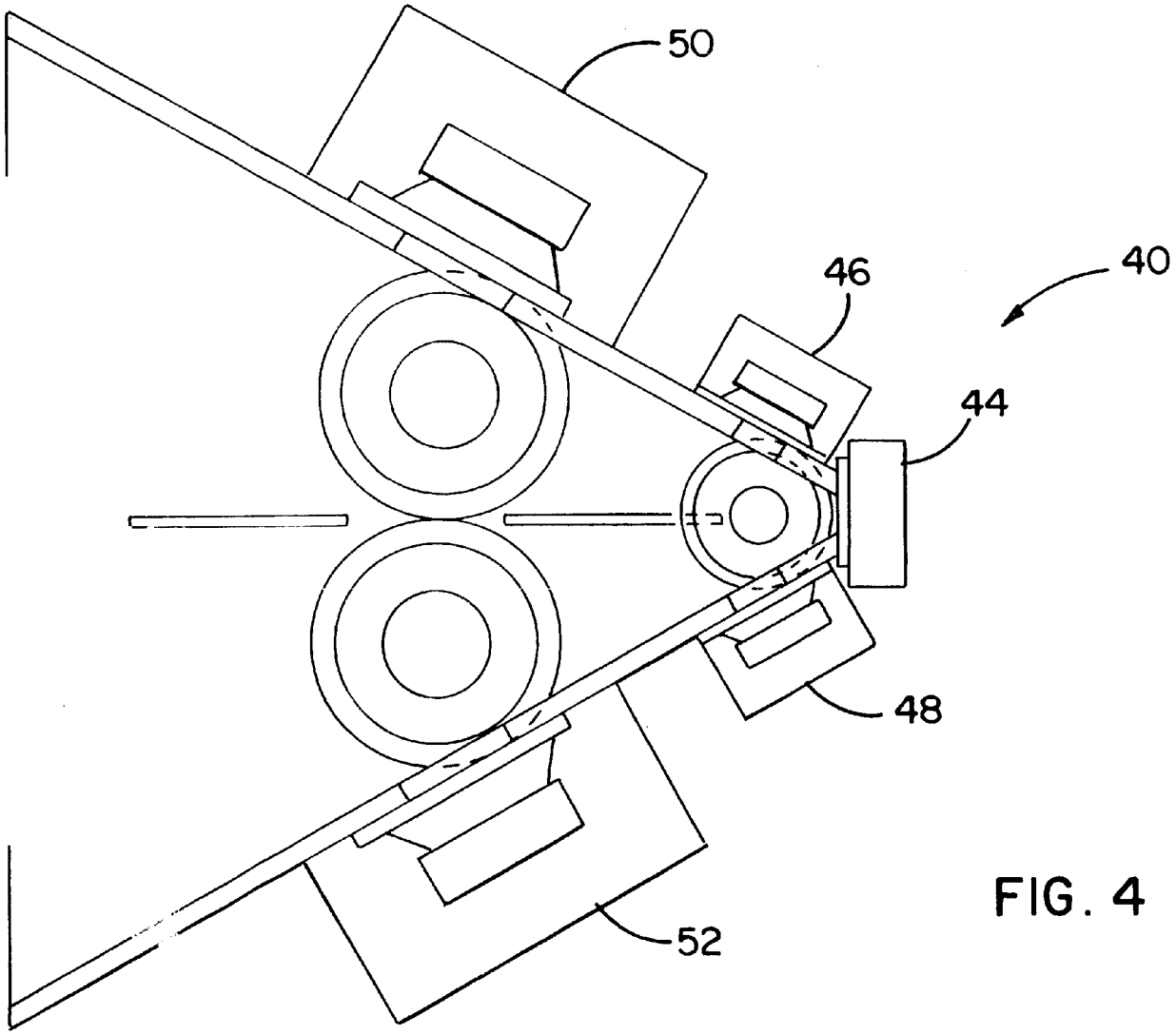
FIG. 4 shows a three-way loudspeaker system.

One can see that for a 1 kHz tone, the mid-drivers are well within the transformation (acoustical impedance matching) zone of the horn, something avoided in other designs. Given that there will always be limitations on the power handling of drivers, one practical way of increasing the power handling of a system is to divide the spectrum into smaller bandwidths given to more drivers. FIG. 4 shows the previous system 30 with additional drivers the following way. The system 40 of the embodiment of FIG. 4 provides a horn 42 with a high frequency driver 44, mid-range pair 46,48, and low frequency pair 50,52. Where, e.g., the system low cutoff is desired as 75 Hz, to divide the spectrum between 75 Hz and 1500 Hz into two equal parts, the crossover at, e.g., 335 Hz, and the ¼λ distance is calculated. Measuring from the mid-driver radiator measure ¼λ towards the mouth and measure the horn area at that point may be determined according to Leach, Jr., W. M., "Specification of Moving-Coil Drivers for Low-Frequency Horn Loudspeakers", 61 st Convention of the Audio Engineering Society, New York (1979), a driver suitable for horn loading between 75 Hz and 335 Hz with the proper throat areas. The drivers are connected through the crossovers and tested. The acoustic amplitude and phase measurement will allow "fine tuning" of the individual passive components in the crossover to partially offset the fact that each acoustic system is a bandpass filter and have some residual reactances not completely swamped by acoustic loading. For this reason, designing each band to be somewhat wider than needed (reducing that segments "extra" reactance) generally results in crossover values closer to straight theory. Unlike current art which depends on steep, high order crossover slopes and electronic time delays to avoid interference, all the drivers in the pyramid system discussed in the present embodiment are highly coupled to each other and generally a first or second order crossover gives the best results to date. Consideration of the amplitude, phase and acoustic impedance of all the elements involved is needed to realize the proper crossover. Until the recently, however, the equipment to measure this information has not been generally available.

While the term pyramid has been referred to many times, the shape of the system is not limited to a four-sided "pyramid". A faceted shape does make driver mounting easier and can be expanded to accommodate nearly any number of drivers but a round or oval profile would also work, possibly better acoustically.

Noncircularly symmetric shapes like the oval or a "line source" may be very useful configurations too. Picture FIG. 4 as a top view of a long stack of drivers producing a "line source". All of the original (plus a few additional) acoustic concerns and parameters are used to calculate such a system except considering there is expansion only in one axis instead of two.

Figure 5A:
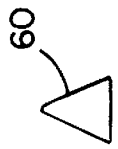
FIG. 5 shows the proposed equivalent circuit for this device embodied as the three-way system of FIG. 4.
Figure 5B:
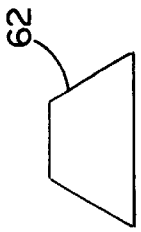
Figure 5C:
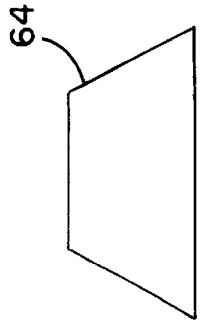
Figure 5:
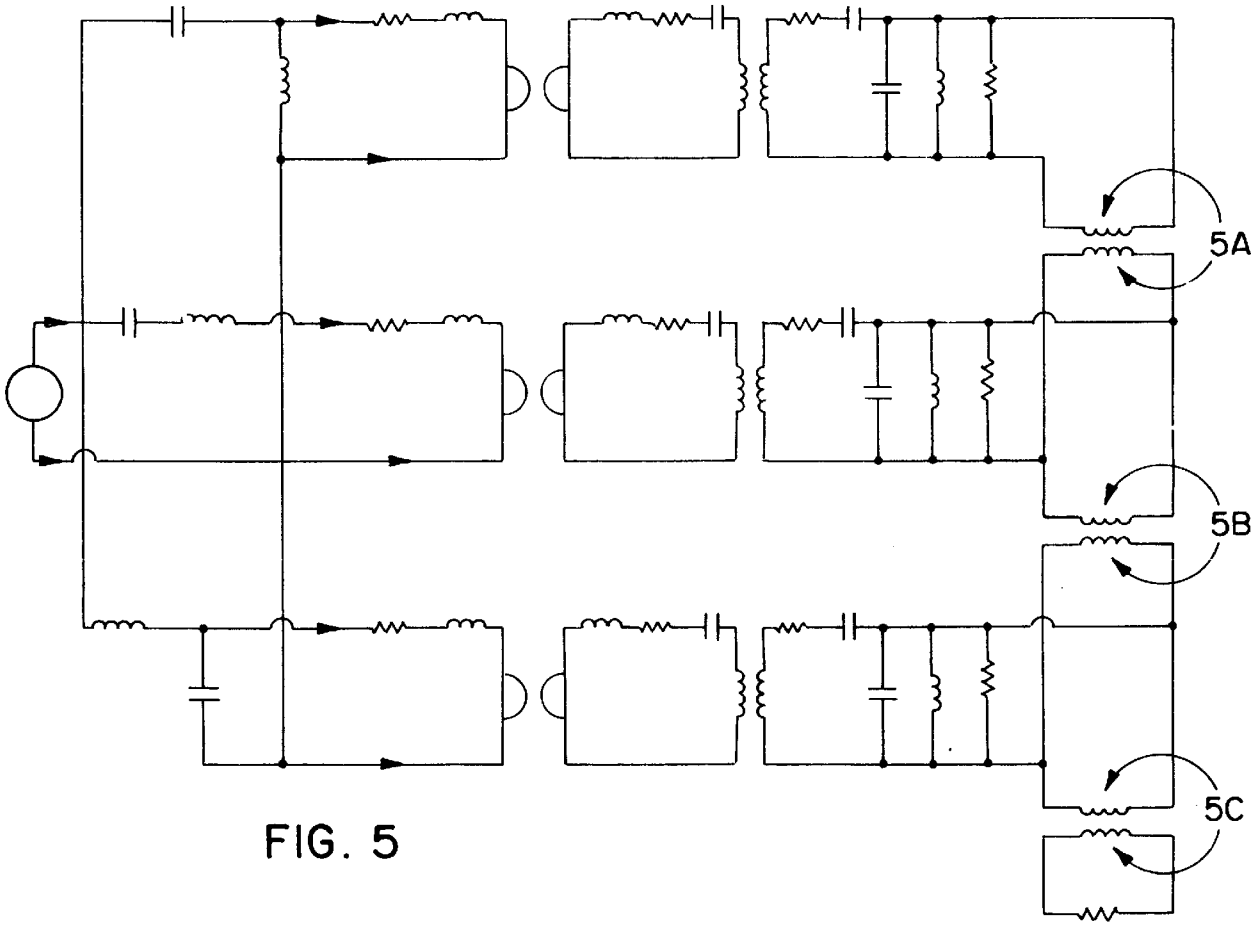

With reference to FIG. 5, there is an equivalent circuit which in effect shows three horn circuits hooked in parallel through the crossover network.

The electrical schematic representation is useful for understanding the Summation processes involved and the sound reproduction in accordance with the above-described embodiments. Operational sections 60, 62, and 64 are illustrated for equivalent frequency responses. As discussed, any number of a variety of horn shapes taking advantage of the frequency characteristics for positioning of the drivers may be used, and it will be appreciated by those skilled in the art that modifications to the foregoing preferred embodiments may be made in various aspects. The present invention therefore is set forth with particularity in the appended claims. It is deemed that the spirit and scope of the invention encompasses such modifications and alterations to the preferred embodiment as would be apparent to one of ordinary skill in the art and familiar in the teachings of audio sound reproduction.

What is claimed is:

1. A sound reproduction system for creating a unified sound source field from a plurality of audio signals, comprising:

a horn of a loudspeaker enclosure having multiply segmented portions according to the frequency response of the horn, comprising a throat and an aperture extending outwardly from the throat;

a loudspeaker driver coupled to the throat of the horn operating in a first one of a plurality of frequency ranges;

a pair of loudspeaker drivers operating in a second one of the plurality of frequency ranges, wherein the second one of the plurality of frequency ranges is at a lower frequency than the first one of the plurality of frequency ranges, said pair of loudspeaker drivers being coupled to a respective one of the multiply segmented portions at a distance from the throat of the horn according to the frequency response of the horn for summation of audio signals generated by each of the respective loudspeaker;

said loudspeaker drivers being positioned for coupling the plurality of audio signals operating in the plurality of frequency ranges into the aperture of the horn; and wherein respective ones of said pair of loudspeaker drivers are coupled to said respective one of said multiply segmented potions at a distance from said throat corresponding to the distance for said audio signals from the loudspeaker driver to travel ¼ wavelength.

2. A system as recited in claim 1 comprising a plurality of throat ports for receiving the loudspeaker drivers upon a surface of the horn wherein said pair of loudspeaker drivers are coupled acoustically to the horn of the loudspeaker enclosure using the throat ports.

3. A sound reproduction system for creating a unified sound source field from a plurality of audio signals, comprising:

a horn of a loudspeaker enclosure having multiply segmented portions according to the frequency response of the horn, comprising a throat and an aperture extending outwardly from the throat;

a loudspeaker driver coupled to the throat of the horn operating in a first one of a plurality of frequency ranges;

a plurality of throat ports for receiving the loudspeaker drivers upon a surface of the horn;

a first pair of loudspeaker drivers operating in a second one of the plurality of frequency ranges, wherein the second one of the plurality of frequency ranges is at a lower frequency than the first one of the plurality of frequency ranges, said first pair of loudspeaker drivers being coupled to a respective one of the multiply segmented portions at a distance from the throat of the horn according to the frequency response of the horn for summation of audio signals generated by each of the respective loudspeaker, wherein said first pair of loudspeaker drivers are coupled acoustically to the horn of the loudspeaker enclosure using the throat ports along an outer surface thereof;

a second pair of loudspeaker drivers coupled to another respective one of the multiply segmented portions of the horn of the loudspeaker enclosure and positioned outwardly and away from the throat operating in a third one of the plurality of frequency range, wherein the third one of the plurality of frequency ranges is at a lower frequency than the first one and the second one of the plurality of frequency ranges, said loudspeaker driver, said first pair of loudspeaker drivers, and said second pair of loudspeaker drivers being acoustically coupled to the horn of the loudspeaker enclosure at respective distances from the throat of the horn for providing a unity summation of an audio sound field at the aperture of the horn;

said first and second pairs of loudspeaker drivers being positioned for coupling the plurality of audio signals operating in the plurality of frequency ranges into the aperture of the horn.

4. A system as recited in claim 3 wherein the horn of the loudspeaker enclosure is provided in the shape of a pyramid.

5. A system as recited in claim 4 wherein said horn is segmented to provide the throat input ports for the introduction of the plurality of audio signals along sides of the pyramid.

6. A system as recited in claim 5 wherein said pyramid comprises four sides.

7. A system as recited in claim 3 wherein respective ones of said pair of loudspeaker drivers are coupled to said respective one of said multiply segmented portions at a distance from said throat compensating for a phase shift between the audio signals generated by the loudspeaker driver and the audio signals generated by the pair of loudspeaker drivers.

8. A system as recited in claim 7 wherein respective ones of said pair of loudspeaker drivers are coupled to said respective one of said multiply segmented portions at a distance from said throat allowing said audio signals generated by said loudspeaker driver to be summed in phase with said audio signals from the pair of loudspeaker drivers.

9. A system as recited in claim 8 wherein respective ones of said pair of loudspeaker drivers are coupled to said respective one of said multiply segmented portions at a distance from said throat corresponding to the distance for said audio signals from the loudspeaker driver to travel ¼ wavelength.

10. A sound reproduction method for providing a unified sound source field from a plurality of signals, comprising:

multiply segmenting a loudspeaker enclosure into various portions of a horn according to the frequency response of the horn with a horn throat and an aperture extending outwardly from the horn throat;

opening a flare of the horn of the loudspeaker enclosure to provide acoustic coupling in predetermined audio frequency ranges;

coupling pairs of loudspeaker drivers providing audio signals to respective ones of the various portions of the horn of the loudspeaker enclosure in accordance with the frequency response of the horn; and operating the acoustically coupled loudspeakers on the loudspeaker enclosure according to the respective frequency response for summation of the audio signals generated by each of the respective loudspeaker sources wherein respective ones of said pair of loudspeaker drivers are coupled to said respective one of said multiply segmented portions at a distance from said throat corresponding to the distance for said audio signals from the loudspeaker driver to travel ¼ wavelength.

11. A method as recited in claim 10 positioning respective ones of the loudspeakers along sides of the horn and out of the way of the audio fields of others of the loudspeakers.

12. A method as recited in claim 11 wherein said coupling step includes a transformation operation for acoustical impedance matching and a waveguide operation for directing the reproduced audio signals as a unity summation at the aperture.

13. A method as recited in claim 12 providing the horn as a four-sided pyramid for accepting loudspeaker pairs along opposing sides of the pyramid to introduce acoustic signals at the respective portions in the horn of the loudspeaker enclosure.

14. A sound reproduction system for creating a unified sound source field from a plurality of signals, comprising:

means for multiply segmenting a loudspeaker enclosure into various portions of a horn according to the frequency response of the horn with a horn throat and an aperture extending outwardly from the horn throat;

means for opening a flare of the horn of the loudspeaker enclosure to provide acoustic coupling in predetermined audio frequency ranges;

means for coupling pairs of loudspeaker drivers providing audio signals to respective ones of the various portions of the horn of the loudspeaker enclosure in accordance with the frequency response of the horn; and means for operating the acoustically coupled loudspeakers on the loudspeaker enclosure according to the respective frequency response for summation of the audio signals generated by each of the respective loudspeaker sources wherein respective ones of said pair of loudspeaker drivers are coupled to said respective one of said multiply segmented portions at a distance from said throat corresponding to the distance for said audio signals from the loudspeaker driver to travel ¼ wavelength.

15. A system as recited in claim 14 comprising means for positioning the loudspeakers along sides of the horn and out of the way of the audio fields of others of the loudspeakers.

16. A system as recited in claim 15 wherein said coupling means comprises means for acoustical impedance matching and for directing the reproduced audio signals as a unity summation at the aperture.

17. A system as recited in claim 16 wherein said horn throat and said aperture extending outwardly from the horn throat of the horn is provided in the shape of a pyramid.

18. A system as recited in claim 16 wherein said horn comprises a pyramid-shaped horn segmented to provide throat input ports for the introduction of the plurality of signals along sides of the pyramid-shaped horn.

19. A system as recited in claim 16 further comprising means for providing the horn as a four-sided pyramid for accepting loudspeaker pairs along opposing sides of the four-sided pyramid to introduce acoustic signals at the respective portions in the horn of the loudspeaker enclosure.

* * * * *